US005186616A

United States Patent [19]

Hirano

[11] Patent Number: 5,186,616

[45] Date of Patent: Feb. 16, 1993

[54] SCROLL TYPE FLUID MACHINERY WITH REDUCED PRESSURE BIASING THE STATIONARY SCROLL

[75] Inventor: Takahisa Hirano, Nagoya, Japan

[73] Assignee: Mitsubishi Jukogyo Kabushiki Kaisha, Tokyo, Japan

[21] Appl. No.: 708,714

[22] Filed: May 31, 1991

[30] Foreign Application Priority Data

Jul. 6, 1990 [JP] Japan ..... 2-179062
Jul. 6, 1990 [JP] Japan ..... 2-179063

[51] Int. Cl.[5] ..... F01C 1/04
[52] U.S. Cl. ..... 418/55.5
[58] Field of Search ..... 418/55.5, 57

[56] References Cited

U.S. PATENT DOCUMENTS 3,874,827 4/1975 Young ..... 418/55.5
4,767,293 8/1988 Caillat et al. ..... 418/55.5

FOREIGN PATENT DOCUMENTS 0037728 10/1981 European Pat. Off. .
0322894 7/1989 European Pat. Off. .
163678 9/1987 Japan .
1195987 2/1988 Japan .
291488 9/1988 Japan .
2149783 11/1988 Japan .
2-125986 5/1990 Japan ..... 418/55.5

*Primary Examiner*—John J. Vrablik

[57] ABSTRACT

A scroll type fluid machinery has a stationary scroll and revolving scroll with spiral elements set up at end plates thereof. The scrolls respectively, are engaged with each other, and a high pressure fluid chamber is formed on the outside of the end plate of the stationary scroll. A low pressure fluid chamber or an intermediate pressure fluid chamber is formed between the end plate of the stationary scroll and the high pressure fluid chamber. As a result, the pressure of a low pressure fluid or an intermediate pressure fluid acts on the outside of the end plate of the stationary scroll. Accordingly, deformation of the end plate is prevented or reduced, and reliability of the fluid machinery may be improved.

17 Claims, 3 Drawing Sheets

SCROLL TYPE FLUID MACHINERY WITH REDUCED PRESSURE BIASING THE STATIONARY SCROLL

FIELD OF THE INVENTION AND RELATED ART STATEMENT

The present invention relates to a scroll type fluid machinery used as a compressor, an expansion machine and the like.

FIG. 4 shows an example of a conventional scroll type compressor.

As shown in FIG. 4, a scroll type compression mechanism C is disposed at an upper part in a closed housing 8, and an electric motor 4 is disposed at a lower part thereof, and these are coupled interlocking with each other by means of a rotary shaft 5.

The scroll type compression mechanism C is provided with a stationary scroll 1, a revolving scroll 2, a mechanism 3 for checking rotation on its axis such as an Oldham's link which allows revolution in a solar motion of the revolving scroll 2 but checks the rotation on its axis thereof, a frame 6 on which the stationary scroll 1 and the electric motor 4 are put in place, an upper bearing 71 and a lower bearing 72 which support the rotary shaft 5, and a rotating bearing 73 and a thrust bearing 74 which support the revolving scroll 2.

The stationary scroll 1 consists of an end plate 11 and a spiral body 12, and a discharge port 13 and a discharge valve 17 which opens and closes the discharge port 13 are provided on the end plate 11.

The revolving scroll 2 consists of an end plate 21, a spiral body 22 and a boss 23. A drive bushing 54 is supported in the boss 23 through the rotating bearing 73. Further, an eccentric pin 53 projected at the upper end of the rotary shaft 5 is supported rotatably in the drive bushing 54.

Lubricating oil 81 stored at the bottom of the housing 8 is sucked up through an inlet hole 51 by means of centrifugal force generated by the rotation of the rotary shaft 5, and passes through an oil filler port 52 and lubricates the lower bearing 72, the eccentric pin 53, the upper bearing 71, the mechanism 3 for checking rotation on its axis, the rotating bearing 73, the thrust bearing 74 and the like, and is discharged to the bottom of the housing 8 through a chamber 61 and a drainage hole 62.

When the electric motor 4 is driven to rotate, the rotation is transmitted to the revolving scroll 2 through a mechanism for driving revolution in a solar motion, viz., the rotary shaft 5, the eccentric pin 53, the drive bushing 54, and the rotating bearing 73, and the revolving scroll 2 revolves in a solar motion while being prevented from rotating on its axis by means of the mechanism 3 for checking rotation on its axis.

Then, gas enters into the housing 8 through a suction pipe 82 and cools the electric motor 4, and thereafter, is sucked into a plurality of closed spaces 24 which are delimited by having the stationary scroll 1 and the revolving scroll 2 with each other through a suction chamber 16 from a suction passage 15 provided in the stationary scroll 1. Then, the gas reaches a central part while being compressed as the volume of the closed spaces 24 is reduced by revolution in a solar motion of the revolving scroll 2, and pushes up a discharge valve 17 from a discharge port 13 and is discharged into a first discharge cavity 14. Then, the compressed gas enters into a second discharge cavity 19 through a hole 18 which is bored on a partition wall 31, and is discharged outside therefrom through a discharge pipe 83. Besides, numeral 84 denotes a balance weight attached to the drive bushing 54.

In the above-mentioned conventional scroll type compressor, high pressure gas discharged from the discharge port 13 enters into the first discharge cavity 14, and high pressure gas in this discharge cavity 14 acts on all over the outer surface of the end plate 11 of the stationary scroll 1, thereby to deform the end plate 11 to show a centrally depressed configuration by approximately several ten μm.

Thus, there has been such a fear that the inner surface of the end plate 11, among others the central part thereof abuts against a tip of the spiral body 22 of the revolving scroll 2, thus generating what is called a scuffing phenomenon.

OBJECT AND SUMMARY OF THE INVENTION

It is an object of the present invention which has been made in view of such a point to provide a scroll type fluid machinery in which the above-described problems have been solved.

In order to achieve the above-mentioned object, the gist of the present invention is as follows.

(I) A scroll type fluid machinery in which a pair of stationary scroll and revolving scroll having spiral elements set up at end plates thereof, respectively, are engaged with each other, and a high pressure fluid chamber is formed on the outside of the end plate of the stationary scroll, characterized in that a low pressure fluid chamber is formed between the end plate of the stationary scroll and the high pressure fluid chamber.

(II) A scroll type fluid machinery in which a pair of stationary scroll and revolving scroll having spiral elements set up at end plates thereof, respectively, are engaged with each other, and a high pressure fluid chamber is formed on the outside of the end plate of the stationary scroll, characterized in that a low pressure fluid chamber is formed between the end plate of the stationary scroll and the high pressure fluid chamber, and the low pressure fluid chamber is made to communicate with a low pressure fluid atmosphere in a closed housing which houses the pair of stationary scroll and revolving scroll, a mechanism for checking rotation on its axis of the revolving scroll and a mechanism for driving revolution in a solar motion of the revolving scroll through a passage provided on the periphery of the low pressure fluid chamber.

The above-described construction being provided in the above-described inventions (I) and (II), the low pressure of the low pressure fluid which is introduced into the low pressure fluid chamber acts on the outer surface of the end plate of the stationary scroll. Thus, deformation of this end plate is prevented or reduced.

In this manner, it is possible to prevent what is called a scuffing phenomenon between the inner surface of the end plate of the stationary scroll and the tip of the spiral element of the revolving scroll from generating, thus improving reliability of a scroll type fluid machinery.

(III) A scroll type fluid machinery in which a pair of stationary scroll and revolving scroll having spiral elements set up on end plates, respectively, are engaged with each other so as to form closed spaces which vary the volume by revolution in a solar motion of the revolving scroll between both of these scrolls, and a high pressure fluid chamber is formed on the outside of the end plate of the stationary scroll, characterized in that an intermediate pressure fluid chamber is formed between the end plate of the stationary scroll and the high pressure fluid chamber, an intermediate pressure introduction hole communicating with the closed spaces is bored in the end plate of the stationary scroll, and the intermediate pressure fluid in the closed spaces is introduced into the intermediate pressure fluid chamber through the hole.

The above-described construction being provided in the present invention, the intermediate pressure fluid in the closed spaces is introduced into the intermediate pressure fluid chamber through the intermediate pressure introduction hole, and the intermediate pressure acts on the outer surface of the end plate of the stationary scroll. Thus, the fluid pressure in the closed spaces acting on the inner surface of the end plate is offset.

As a result, it is possible to prevent or reduce deformation of the end plate of the stationary scroll. Accordingly, it is possible to prevent what is called a scuffing phenomenon from generating between the inner surface of the end plate of the stationary scroll and the tip of the spiral element of the revolving scroll, thereby to improve reliability of a scroll type fluid machinery.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
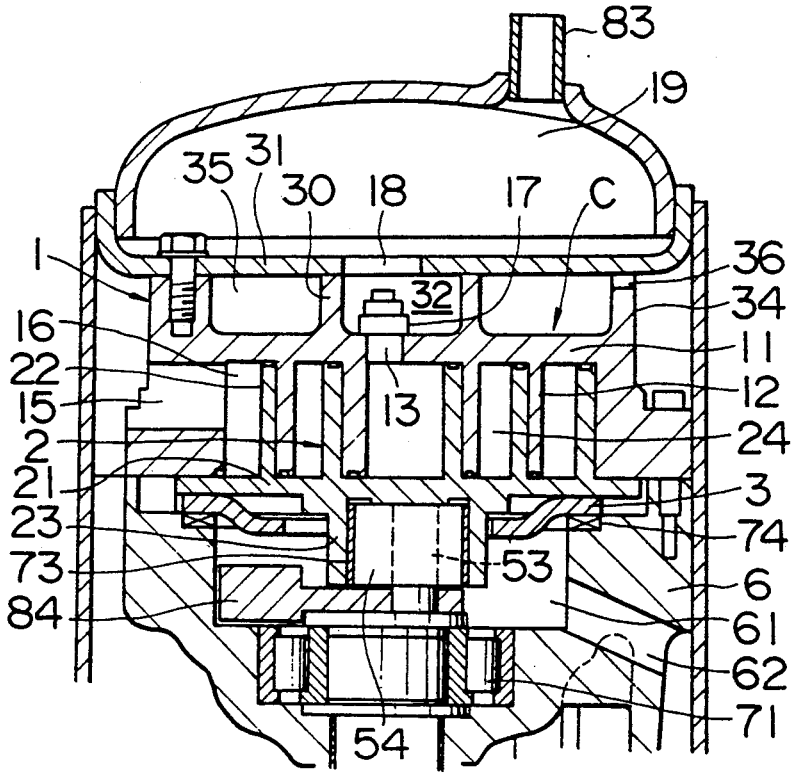
FIG. 1 is a partial longitudinal sectional view showing a first embodiment of the present invention.

FIG. 1 shows a first embodiment of the present invention.

A cylindrical boss 30 surrounding a discharge port 13 is formed on an upper surface of an end plate 11 of a stationary scroll 1, and a tip of this boss 30 abuts against an underside of a partition wall 31 in a sealing manner. A first discharge cavity 32 is delimited by the inner circumferential surface of the boss 30, the outer surface of the end plate 11 and the inner surface of the partition wall 31, and a discharge valve 17 is disposed in the first discharge cavity 32.

Further, an annular low pressure fluid chamber 35 is delimited by an inner circumferential surface of an annular flange 34 set up integrally on the periphery of the outer surface of the end plate 11, the outer circumferential surface of the cylindrical boss 30, the outer surface of the end plate 11 and the inner surface of the partition wall 31, and the low pressure fluid chamber 35 communicates with the space in the housing 8 at low pressure, viz., a low pressure fluid atmosphere through a notch 36 formed in the flange 34.

Figure 4:
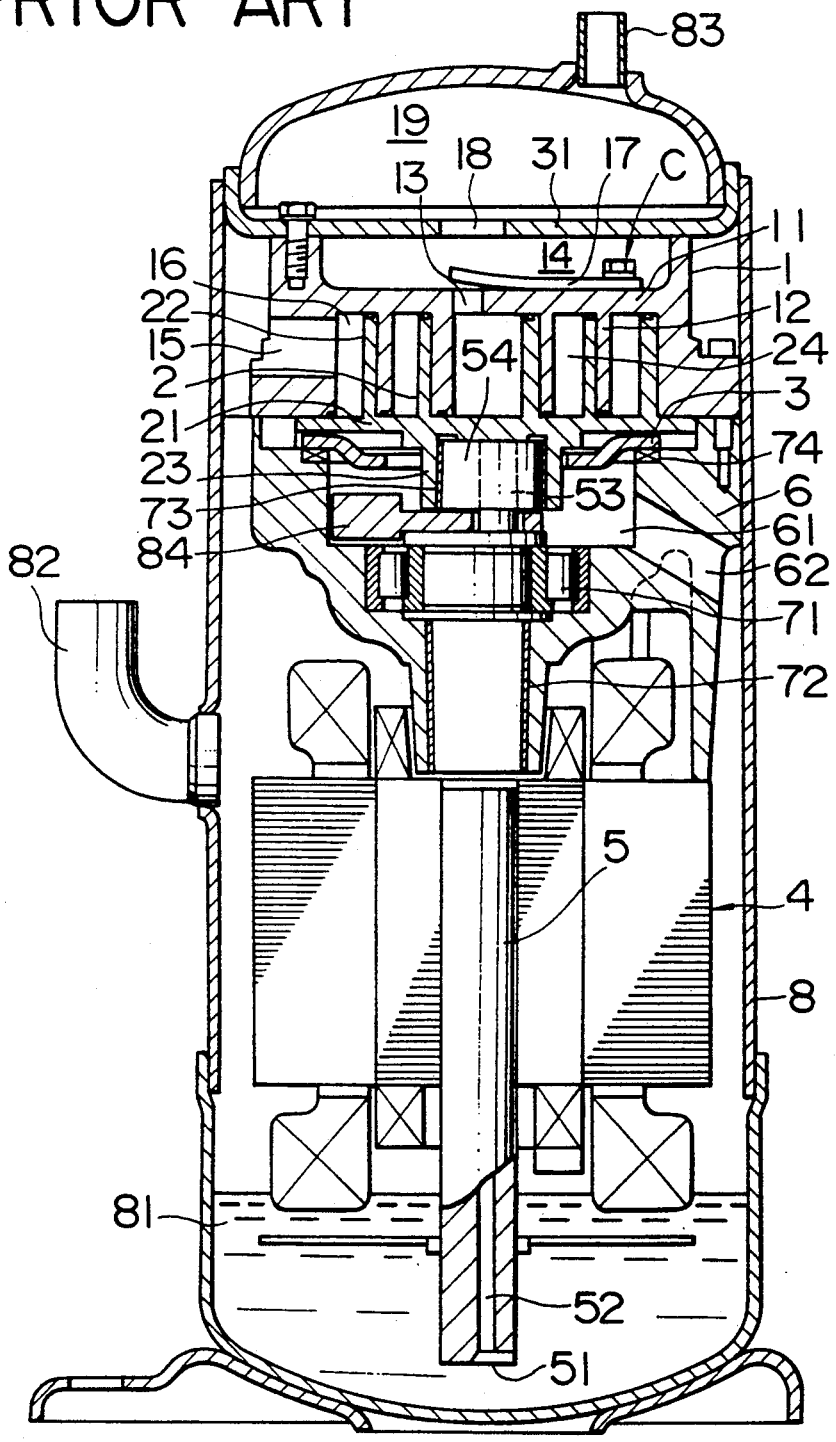
FIG. 4 PRIOR ART
FIG. 4 is a longitudinal sectional view of a conventional scroll type compressor.

Other construction is the same as that of a conventional device shown in FIG. 4, and the same symbols are affixed to corresponding members.

Now, the low pressure gas sucked into the housing 8 is introduced into the annular low pressure chamber 35 through the notch 36. Thus, the gas pressure acting on the outer surface of the end plate 11 of the stationary scroll 1 is reduced. Therefore, the force which presses the end plate 11 downward becomes remarkably smaller as compared with a conventional case, thus preventing or reducing downward deformation of the end plate 11.

Figure 2:
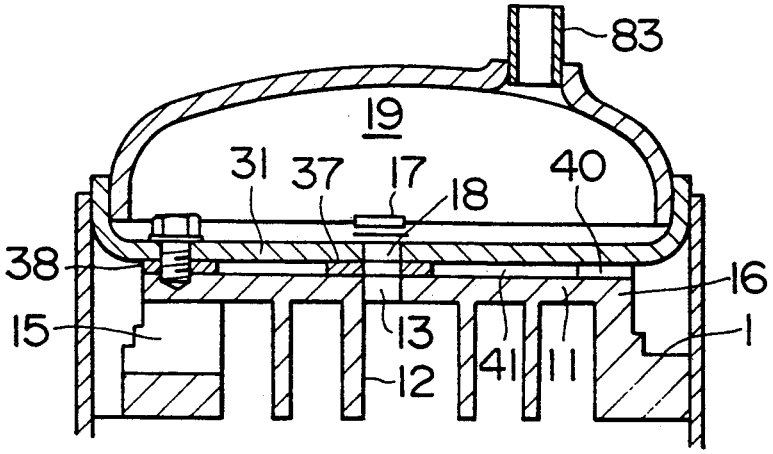
FIG. 2 is a partial longitudinal sectional view showing a second embodiment of the present invention.

FIG. 2 shows a second embodiment of the present invention.

In the embodiment shown in FIG. 2, an annular gasket 37 is placed on the upper surface of the end plate 11 of the stationary scroll 1 so as to surround the discharge port 13 and an annular gasket 38 is also placed on an outer circumferential edge of the upper surface of the end plate 11 and these gaskets 37 and 38 are adhered to the underside of the partition wall 31.

Further, a discharge valve 17 is disposed in a second discharge cavity 19, and a hole 18 is opened and closed by means of this discharge valve 17. Also, a notch 40 is formed at a part of the gasket 38.

In this manner, a low pressure fluid chamber 41 is delimited by the outer circumferential surface of the gasket 37, the inner circumferential surface of the gasket 38, the top surface of the end plate 11 and the underside of the partition wall 31, and the low pressure chamber 41 communicates with the space in the housing 8 at low pressure, viz., a low pressure fluid atmosphere through the notch 40.

In the second embodiment, the first discharge cavity 32 no longer exists, but the area of the low pressure fluid chamber 41 may be made larger than that in the first embodiment, and the structure can also be simplified.

As described above, according to the present invention, since a low pressure fluid chamber is formed between an end plate of a stationary scroll and a high pressure fluid chamber, a low pressure of a low pressure fluid introduced into the low pressure fluid chamber acts on an outer surface of an end plate of a stationary scroll. Therefore, deformation of the end plate is prevented or reduced.

Figure 3:
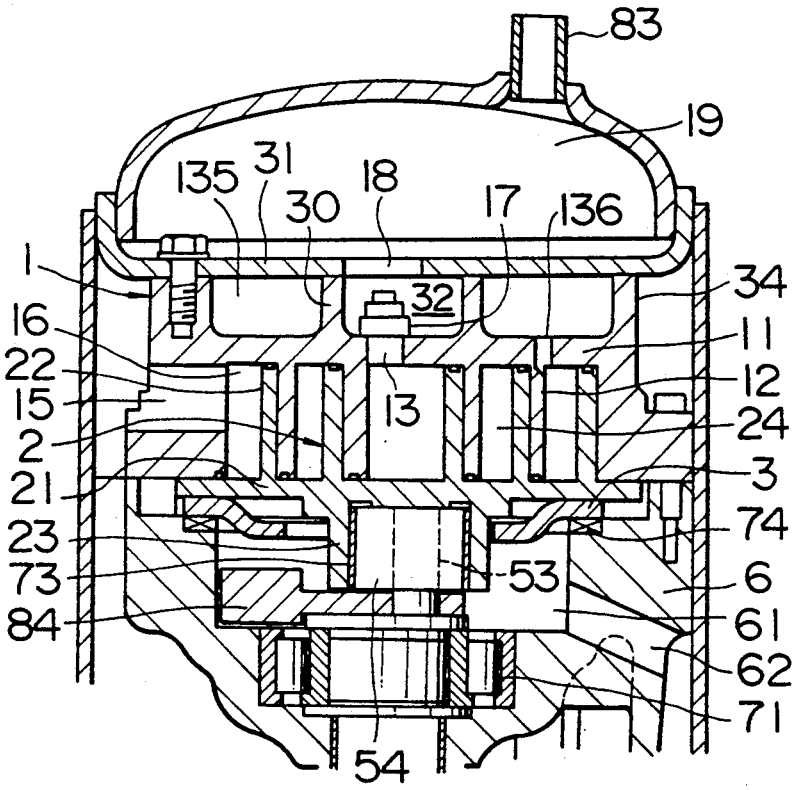
FIG. 3 is a partial longitudinal sectional view showing a third embodiment of the present invention.

In the next place, FIG. 3 shows a third embodiment of the present invention.

A cylindrical boss 30 surrounding the discharge port 13 is formed on the top surface of the end plate 11 of the stationary scroll 1, and the tip of this boss 30 abuts against the underside of the partition wall 31 in a sealing manner. A first discharge cavity 32 is delimited by the inner circumferential surface of the boss 30, the outer surface of the end plate 11 and the inner surface of the partition wall 31, and the discharge valve 17 is disposed in the first discharge cavity 32.

Further, an annular intermediate pressure fluid chamber 135 is delimited by the inner circumferential surface of the annular flange 34 set up integrally on the periphery of the outer surface of the end plate 11, the outer circumferential surface of the cylindrical boss 30, the outer surface of the end plate 11 and the inner surface of the partition wall 31. This intermediate pressure fluid chamber 135 communicates with the closed spaces 24 during compression through an intermediate pressure introduction hole 136 which is bored in the end plate 11.

Other construction is similar to that of conventional device shown in FIG. 4, and same symbols are affixed to corresponding members.

During the operation of a compressor, the fluid pressure in the closed spaces 24 increases as going toward the center of the spiral, and the end plate 11 of the stationary scroll 1 is pressed upward by the fluid pressure in the closed spaces 24.

On the other hand, gas at an intermediate pressure in the closed spaces 24 during compression is introduced into the annular intermediate pressure fluid chamber 135 through the gas intermediate pressure introduction hole 136, and the end plate 11 of the stationary scroll 1 is pressed downward by the intermediate pressure fluid in the intermediate pressure fluid chamber 135.

The intermediate pressure MP in the closed small chamber 24 during compression is expressed as:

$$MP = LP\left(\frac{Vth}{V}\right)^{\kappa}$$

where,

LP is suction pressure,

Vth is displacement,

V is the volume of the closed chamber communicating with the introduction hole 136, and $\kappa$ is an adiabatic exponent, and the pressure MP depends on the suction pressure LP.

Thus, it is possible to make the difference between the force to push the end plate 11 downward by the intermediate pressure fluid chamber 135 and the force to push the end plate 11 upward by the fluid in the closed spaces 24 very small even in case operating conditions of a compressor are varied. As a result, it is possible to prevent or reduce deformation of the end plate 11.

As described above, according to the present invention, a partition wall is provided between an end plate of a stationary scroll and a high pressure fluid chamber, and an intermediate pressure fluid chamber into which the intermediate pressure fluid in the closed spaces is introduced through an intermediate pressure introduction hole bored in the end plate is formed between the partition wall and the end plate of the stationary scroll. Thus, an intermediate pressure acts on the outer surface of the end plate of the stationary scroll, thereby to offset the fluid pressure in the closed spaces which acts on the inner surface of the end plate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A scroll type fluid machinery disposed in a housing comprising:

a stationary scroll and a revolving scroll having end plates, each end plate having a spiral element and the spiral elements being engageable with each other;

means forming a high pressure fluid chamber on an outside of the end plate of said stationary scroll and the high pressure fluid chamber being in communication with a discharge port defined in the stationary scroll;

a low pressure fluid chamber being formed between the end plate of the stationary scroll and said means forming a high pressure fluid chamber;

a first annular member surrounding the discharge port in the stationary scroll;

a second annular member at a periphery of the end plate of the stationary scroll, a passage being formed in the second annular member to communicate the low pressure fluid chamber with a low pressure fluid atmosphere in the housing; and a partition wall disposed at end surfaces of the first and second annular members, the end surfaces of the first and second annular members being in sealing engagement with the partition wall;

the low pressure fluid chamber being formed by said end plate, both of said annular members and said partition wall, said low pressure chamber receiving low pressure fluid.

2. The scroll type fluid machinery according to claim 1, wherein said low pressure fluid chamber is formed on an outer circumferential side of the first annular member, the first annular member defines a passage which surrounds the discharge port provided in the stationary scroll, the discharge port being at a central part of the end plate of said stationary scroll, the passage communicates said port with said high pressure fluid chamber.

3. The scroll type fluid machinery according to claim 1, wherein the housing has sides, the housing encloses the stationary scroll, the revolving scroll, the high pressure fluid chamber, the low pressure fluid chamber and the first and second annular members, the first and second annular members being spaced a predetermined distance from the sides of the housing with a gap being defined by the predetermined distance.

4. The scroll type fluid machinery according to claim 3, wherein the partition wall extends between the sides of the housing and forms an upper surface for the gap.

5. The scroll type fluid machinery according to claim 1, wherein the second annular member surrounds the first annular member, the first and second annular members being positioned between the stationary scroll and the partition wall, and the high pressure chamber being spaced at least from outer ends of the stationary scroll by the low pressure fluid chamber.

6. The scroll type fluid machinery according to claim 1, wherein the annular members are integrally formed with the stationary scroll.

7. The scroll type fluid machinery according to claim 1, wherein the annular members are annular gaskets positioned between the stationary scroll and the partition plate.

8. A scroll type fluid machinery comprising:

a stationary scroll and a revolving scroll having end plates, each end plate having a spiral element and the spiral elements being engageable with each other;

means forming a high pressure fluid chamber on an outside of the end plate of said stationary scroll and the high pressure fluid chamber being in communication with a discharge port defined in the stationary scroll;

two annular members disposed between an outside of the end plate of the stationary scroll and the means forming a high pressure fluid chamber, said two annular members being formed integrally with the end plate of the stationary scroll;

a partition wall disposed at end surfaces of the first and second annular members;

a low pressure fluid chamber formed by said end plate, both of said annular members and said partition wall, said low pressure chamber receiving low pressure fluid; and a passage defined in one of said annular members, the passage extending between the low pressure chamber and a housing in which the stationary and revolving scrolls are positioned.

9. A scroll type fluid machinery comprising:

a stationary scroll and a revolving scroll having end plates, each end plate having a spiral element and the spiral elements being engageable with each other;

means including a partition wall defining a high pressure fluid chamber on an outside of the end plate of said stationary scroll and the high pressure fluid chamber being in communication with a discharge port defined in the stationary scroll;

a first annular member surrounding the discharge port in the stationary scroll;

a second annular member at a periphery of the end plate of the stationary scroll;

said partition wall being disposed at end surfaces of the first and second annular members, the end surfaces of the first and second annular members being in sealing engagement with the partition wall;

a low pressure fluid chamber being formed between the end plate of the stationary scroll, said means defining a high pressure fluid chamber by the partition wall and said first and second annular members and said low pressure fluid chamber communicating with a low pressure fluid atmosphere in the closed housing; and a passage provided in one of said annular members on a periphery of said low pressure fluid chamber, the passage communicating the low pressure fluid chamber with the low pressure fluid atmosphere in the closed housing to thereby introduce low pressure into the low pressure fluid chamber.

10. The scroll type fluid machinery according to claim 6, wherein said passage is a notch.

11. The scroll type fluid machinery according to claim 6, wherein said passage is a notch and wherein at least the one annular member having the notch is an annular gasket located on the periphery of said low pressure fluid chamber formed with a partition wall.

12. The scroll type fluid machinery according to claim 8, wherein both of the annular members are annular gaskets disposed between the outside of the end plate of said stationary scroll and the partition wall.

13. The scroll type fluid machinery according to claim 9, wherein the housing further houses the high pressure fluid chamber, the low pressure fluid chamber and the first and second annular members, the first and second annular members being spaced a predetermined distance from the sides of the housing with a gap being defined by the predetermined distance.

14. The scroll type fluid machinery according to claim 13, wherein the partition wall extends between the sides of the housing and forms an upper surface for the gap.

15. The scroll type fluid machinery according to claim 9, wherein the second annular member surrounds the first annular member, the first and second annular members being positioned between the stationary scroll and the partition wall, and the high pressure chamber being spaced at least from outer ends of the stationary scroll by the low pressure fluid chamber.

16. The scroll type fluid machinery according to claim 9, wherein the annular members are integrally formed with the stationary scroll.

17. The scroll type fluid machinery according to claim 9, wherein the annular members are annular gaskets positioned between the stationary scroll and the partition plate.

* * * * *